US007297080B2

(12) United States Patent
Severa et al.

(10) Patent No.: US 7,297,080 B2
(45) **Date of Patent: *Nov. 20, 2007**

(54) GAME RACQUET WITH SEPARATE HEAD AND HANDLE PORTIONS FOR REDUCING VIBRATION

(75) Inventors: William D. Severa, Darien, IL (US); Po-Jen Cheng, Rancho Santa Fe, CA (US); Gerald J. LeVault, Addison, IL (US); Donald G. Loeffler, Arlington Heights, IL (US)

(73) Assignee: Wilson Sporting Goods Co., Chicago, IL (US)

( * ) Notice: Subject to any disclaimer, the term of this patent is extended or adjusted under 35 U.S.C. 154(b) by 266 days.

This patent is subject to a terminal disclaimer.

(21) Appl. No.: 11/030,451

(22) Filed: Jan. 6, 2005

(65) Prior Publication Data

US 2005/0181896 A1 Aug. 18, 2005

Related U.S. Application Data

(63) Continuation-in-part of application No. 10/654,172, filed on Sep. 3, 2003, now Pat. No. 6,840,874, which is a continuation-in-part of application No. 10/277,672, filed on Oct. 22, 2002, now Pat. No. 6,663,516, which is a continuation of application No. 09/849,965, filed on May 4, 2001, now Pat. No. 6,500,080.

(51) Int. Cl.
*A63B 49/10* (2006.01)

(52) U.S. Cl. ..... 473/536; 473/535; 473/521; 473/546

(58) Field of Classification Search ..... 473/520, 473/521, 524, 531, 532, 535, 536, 546, 547, 473/549

See application file for complete search history.

(56) References Cited

U.S. PATENT DOCUMENTS

| | | | | |
|---|---|---|---|---|
| 3,958,805 | A | 5/1976 | Cooper | |
| 3,990,701 | A | 11/1976 | Kim | |
| 4,139,194 | A * | 2/1979 | Fischer | 473/521 |
| 4,194,738 | A * | 3/1980 | Inoue et al. | 473/535 |
| 4,311,308 | A | 1/1982 | Völkl et al. | |
| 4,634,124 | A | 1/1987 | Yuhas et al. | |
| 4,643,857 | A * | 2/1987 | Cousin et al. | 264/46.6 |
| 4,746,119 | A | 5/1988 | Jeanrot | |
| 4,906,002 | A | 3/1990 | Goffney et al. | |
| 4,915,382 | A | 4/1990 | Madsen | |
| 4,988,100 | A | 1/1991 | Shu et al. | |
| 5,071,125 | A * | 12/1991 | Shen | 473/521 |
| 5,133,552 | A | 7/1992 | Feeney et al. | |
| 5,263,712 | A | 11/1993 | Lo | |
| 5,333,858 | A * | 8/1994 | Fagot | 473/521 |

(Continued)

FOREIGN PATENT DOCUMENTS

DE 39 23 268 1/1991

(Continued)

*Primary Examiner*—Raleigh W. Chiu
(74) *Attorney, Agent, or Firm*—Terence P. O'Brien

(57) ABSTRACT

A game racquet includes head portion and a handle portion. The head and handle portions include one or both of a fiber-reinforced thermoset material and a fiber-reinforced thermoplastic material. The handle portion is coupled to the head portion by shock and/or vibration absorbing material.

30 Claims, 18 Drawing Sheets

U.S. PATENT DOCUMENTS

| | | | | |
|---|---|---|---|---|
| 5,524,884 | A * | 6/1996 | Haines | 473/521 |
| 5,560,600 | A | 10/1996 | FitzSimons et al. | |
| 5,865,694 | A | 2/1999 | Duong-Van | |
| 6,027,420 | A | 2/2000 | Soong | |
| 6,071,203 | A | 6/2000 | Janes et al. | |
| 6,500,080 | B2 | 12/2002 | Severa et al. | |
| 6,663,514 | B2 * | 12/2003 | Niwa et al. | 473/521 |
| 6,663,515 | B1 * | 12/2003 | Pai | 473/535 |
| 6,663,516 | B2 | 12/2003 | Severa et al. | |
| 6,688,997 | B2 * | 2/2004 | Ashino et al. | 473/535 |
| 2002/0165050 | A1 * | 11/2002 | Severa et al. | 473/524 |
| 2003/0036447 | A1 * | 2/2003 | Niwa et al. | 473/520 |
| 2003/0036448 | A1 * | 2/2003 | Severa et al. | 473/521 |
| 2004/0043845 | A1 * | 3/2004 | Severa et al. | 473/521 |

FOREIGN PATENT DOCUMENTS

| | | |
|---|---|---|
| DE | 91 12 748.3 | 1/1992 |
| EP | 0 130 620 | 1/1985 |
| EP | 0 519 312 | 12/1992 |
| EP | 0 531 806 | 3/1993 |
| EP | 1 254 682 | 11/2002 |
| FR | 2 399 187 | 2/1979 |
| FR | 2 579 898 | 10/1986 |
| FR | 2 607 397 | 6/1988 |
| GB | 2 187 392 | 9/1987 |
| JP | 150141/1977 | 12/1977 |
| JP | 40575/1988 | 2/1988 |
| JP | 212138/1993 | 8/1993 |
| JP | 506739/1996 | 7/1996 |
| JP | 285567/1997 | 11/1997 |
| WO | WO86/04251 | 7/1986 |
| WO | WO91/12857 | 9/1991 |

* cited by examiner

GAME RACQUET WITH SEPARATE HEAD AND HANDLE PORTIONS FOR REDUCING VIBRATION

RELATED U.S. APPLICATION DATA

The present application is a continuation-in-part application of U.S. patent application Ser. No. 10/654,172, entitled "Game Racquet With Separate Head And Handle Portions For Reducing Vibration," filed on Sep. 3, 2003, now U.S. Pat. No. 6,840,874 which is a continuation-in-part application of U.S. patent application Ser. No. 10/277,672 filed on Oct. 22, 2002 by Severa et al., now U.S. Pat. No. 6,663,516, which is a continuation of U.S. patent application Ser. No. 09/849,965, now U.S. Pat. No. 6,500,080 filed on May 4, 2001.

FIELD OF THE INVENTION

This invention relates to game racquets, and, more particularly, to a game racquet with separate head and handle portions, which are separated by, and joined with, shock and/or absorbing material.

BACKGROUND OF THE INVENTION

Game racquets such as tennis racquets, racquetball racquets, and squash racquets include a head portion and a handle portion. The head portion supports a string bed, and the player holds the racquet by the handle portion.

When the head portion strikes a ball, shock and vibration are transmitted from the head portion through the handle portion to the player's arm. Such shock and vibration can cause discomfort and can lead to physical problems such as tendinitis or tennis elbow.

Shock is caused by the impact of a ball on the strings. Shock on a typical tennis racquet might last about 3 milliseconds after ball impact.

Vibration is caused by shock and lasts longer. Vibration might last about 1000 milliseconds in a typical tennis racquet.

Many prior attempts have been made to reduce the transmission of shock and vibration to the player's arm. However, any direct connection between the head portion and the handle portion can provide an area through which shock and vibration can be transmitted. A conventional one-piece racquet acts as a conduit of vibration from the head to the handle.

U.S. Pat. No. 4,609,198 describes a racquet in which a tubular damping pad is positioned within the grip of the racquet.

SUMMARY OF THE INVENTION

The invention provides a game racquet with separate head and handle portions. The handle portion includes arms which extend along portions of the head, and the head and handle portions are separated by, and joined with, shock and/or vibration absorbing material such as urethane or rubber which reduces the transmission of shock and vibration from the head portion to the handle portion.

The head and handle portions are advantageously joined to the shock and/or vibration absorbing material by adhesive or an adhesive agent. If desired, an additional mechanical connection between the head and handle portions can be provided, for example, by strings which extend through string holes in both the head and the handle portions.

The shock and/or vibration absorbing material is advantageously urethane, natural rubber, butyl rubber, or synthetic rubber and has a Shore A hardness within the range of 0 to 90, more preferably within the range of 20 to 70, and most preferably within the range of 30 to 60. Other relatively soft polymeric materials could also be used.

BRIEF DESCRIPTION OF THE DRAWINGS

The invention will be explained in conjunction with the attached drawing, in which—

DETAILED DESCRIPTION OF THE PREFERRED EMBODIMENTS

Figure 1:
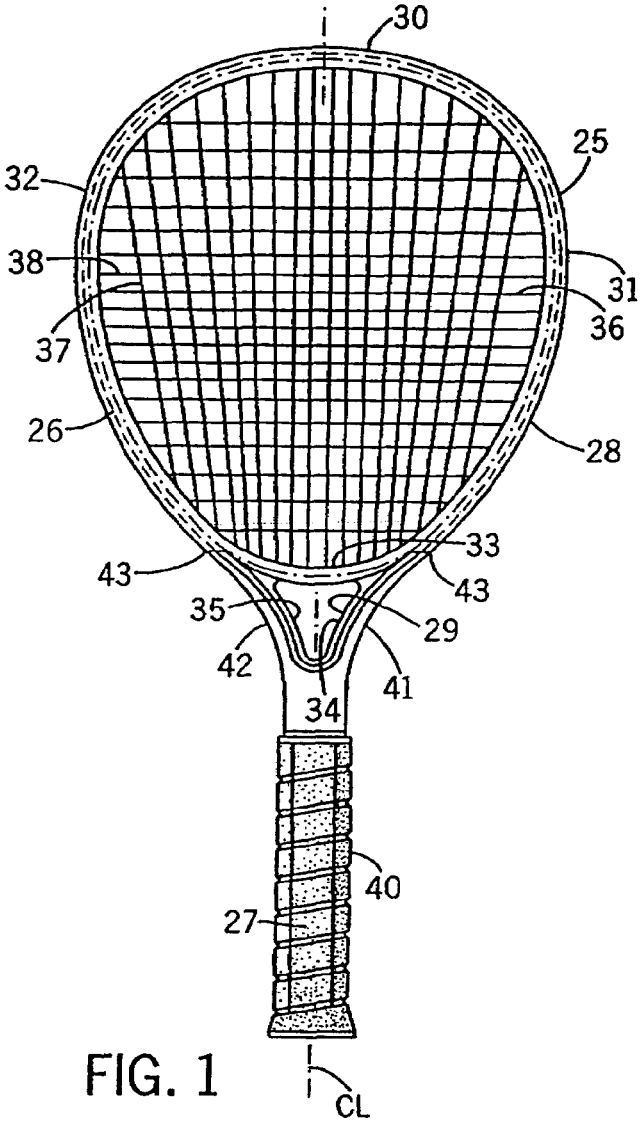
FIG. 1 is a front view of one embodiment of a game racquet which is formed in accordance with the invention.
Figure 2:
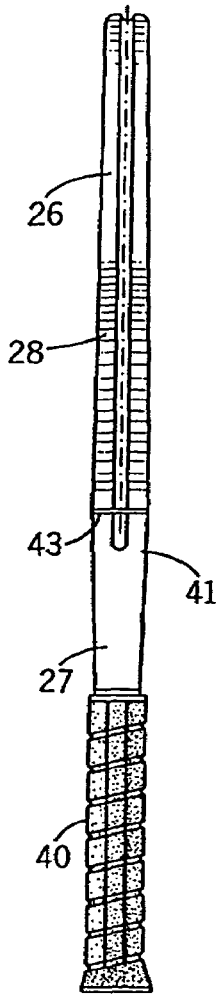
FIG. 2 is a side view of the racquet of FIG. 1.

Referring to FIGS. 1 and 2, a tennis racquet 25 includes a head portion 26 and a handle portion 27. The handle is aligned with a longitudinal centerline CL of the racquet. Although the invention will be explained with reference to a tennis racquet, it will be understood that the invention can be used with other game racquets such as racquetball racquets and squash racquets.

The head and handle portions can be formed from any conventional material for game racquets. For example, either or both of the head and handle portions could be made from thermoplastic or thermoset materials or a combination of thermoplastic and thermoset materials. The preferred material is a graphite and resin composite. The head and handle portions can be formed from the same or different materials.

A thermoplastic is a material which will soften, flow, or distort appreciably when subjected to sufficient heat and pressure. Thermoplastic resins dampen vibrations and shock exceptionally well. Thermoplastic resins also are highly abrasion resistant and highly impact resistant. A thermoset material is a material which, after being initially cured, will not soften, flow, or distort appreciably when subjected to sufficient heat and pressure. Thermoset resins are significantly stiffer and lighter than thermoplastic resins. Thermoset resins are also generally more workable and easier to manufacture. For example, a thermoset resin typically requires an oven, furnace or mold temperature of approximately 300-350 F. to produce, while a thermoplastic resin typically requires an oven, furnace or mold temperature of approximately 550-650 F.

In one particularly preferred embodiment, the hoop portion of the racquet is formed of a fiber reinforced thermoset resin material, and the handle is formed of a fiber reinforced thermoplastic resin material. The fibers are a high tensile strength material, such as, graphite. Alternatively, the fibers can be formed of other materials, such as, for example, fiberglass, carbon, ceramic, aramid, Kevlar®, high molecular weight polyethylene in strand form, other conventional fiber materials or combinations thereof. The fibers are preferably elongate fibers arranged in a laminated stack configuration. Alternatively, the fibers can be fiber segments mixed into the thermoset or thermoplastic resin, or eliminated entirely. The thermoplastic material of the handle portion is preferably nylon. However, other thermoplastic materials can also be used in the handle portion, such as, for example, urethane, ABS, polyvinylchloride or combinations thereof.

In this particularly preferred embodiment, the thermoset material provides the hoop portion with exceptional stiffness at a very low weight. The reduced weight increases the design flexibility of the racquet enabling weight, which would otherwise be incorporated into the hoop portion, to be: redistributed to one or more alternate locations about the racquet; eliminated altogether; or addressed through a combination thereof. The exceptional dampening characteristics of the thermoplastic material of the handle portion serve to reduce the amount of shock and/or vibration felt by the user gripping the handle portion. The thermoplastic material of the handle portion also can be used to increase the flexibility of the handle portion.

In an alternative particularly preferred embodiment, the opposite configuration can be used. The hoop portion can be formed of a thermoplastic fiber-reinforced material and the handle portion can be formed of a thermost fiber-reinforce material. In this particularly preferred embodiment, the thermoplastic material of the hoop portion significantly increases the impact and abrasion resistance of the hoop portion thereby increasing the durability and life of the racquet. The increased impact and abrasion resistance is desired because it is not uncommon for the hoop portion of sports racquets to contact the ground during play. This embodiment is particularly advantageous in racquetball, where the racquetball racquet typically and routinely contacts the ground and walls during play. The dampening characteristics of the thermoplastic material serve to reduce amount of shock and vibration that is transferred to the handle portion.

The head portion includes a hoop 28 and a generally V-shaped throat portion 29. The hoop includes a top portion 30, side portions 31 and 32, and a bottom or yoke portion 33. The throat includes a pair of arms 34 and 35, which converge downwardly and inwardly from the sides of the hoop.

A string bed 36 is supported by the hoop 28 in the conventional manner. The string bed includes longitudinally extending main strings 37 and cross strings 38.

The handle portion 27 includes a grip portion 40 which is wrapped with grip material and a throat portion which is formed from a pair of arms 41 and 42 which diverge outwardly and upwardly from the grip portion. Each arm includes an upper end 43, which is adjacent the juncture between the yoke 33 and the sides 31 and 32 of the hoop.

As will be explained in detail with respect to the embodiment illustrated in FIG. 3, material which absorbs shock and/or vibration is positioned between the head and handle portions and isolates the head and handle portions. Each of the head and handle portions is attached to the shock and/or vibration absorbing material, advantageously by adhesive or an adhesive agent, and the head and handle are thereby connected to each other.

Figure 3:
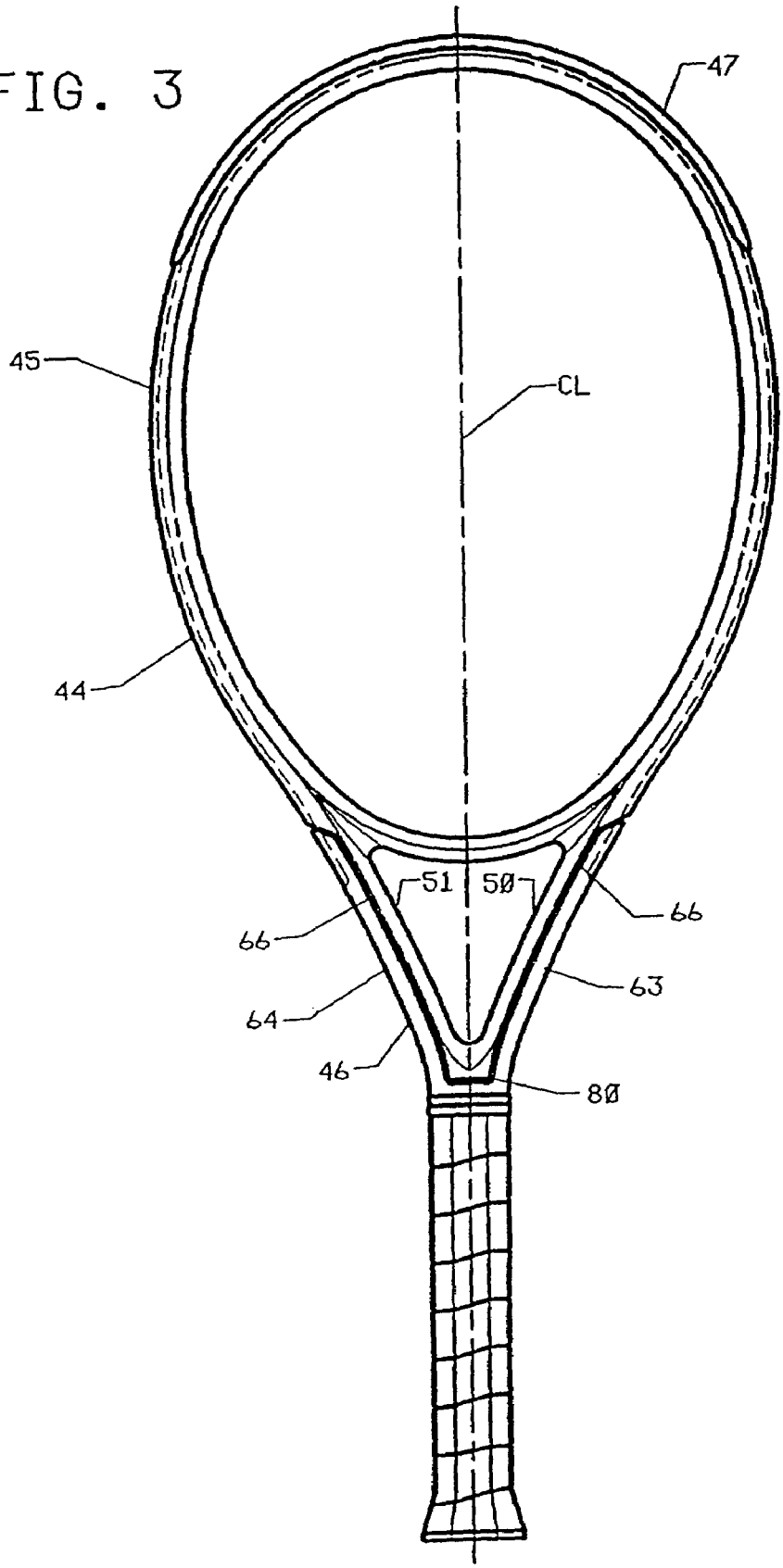
FIG. 3 is a front view of another embodiment of a racquet which is formed in accordance with the invention.
Figure 4:
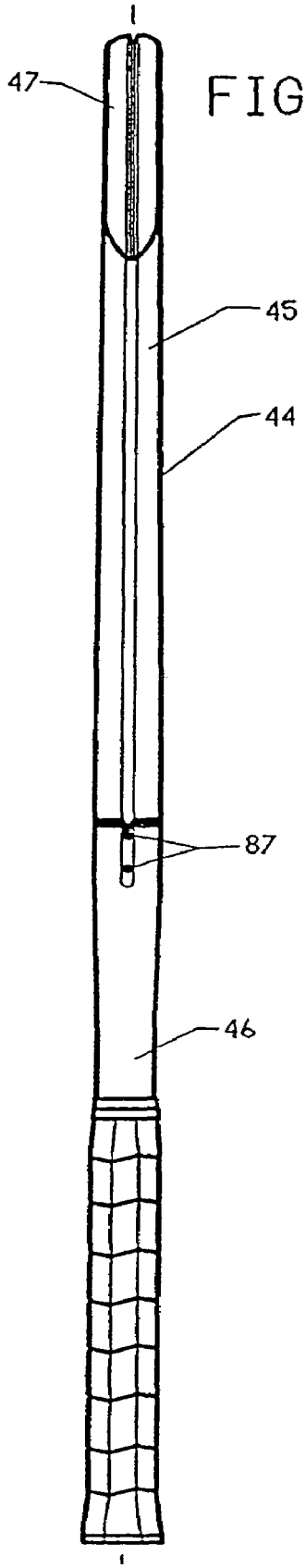
FIG. 4 is a side view of the racquet of FIG. 3.

FIGS. 3 and 4 illustrate another embodiment of a racquet 44 which is similar to the racquet 25. The racquet 44 includes a head portion 45 and a handle portion 46, which extends along the centerline CL of the racquet. A bumper strip 47 can protect the top of the head portion if desired.

Figure 5:
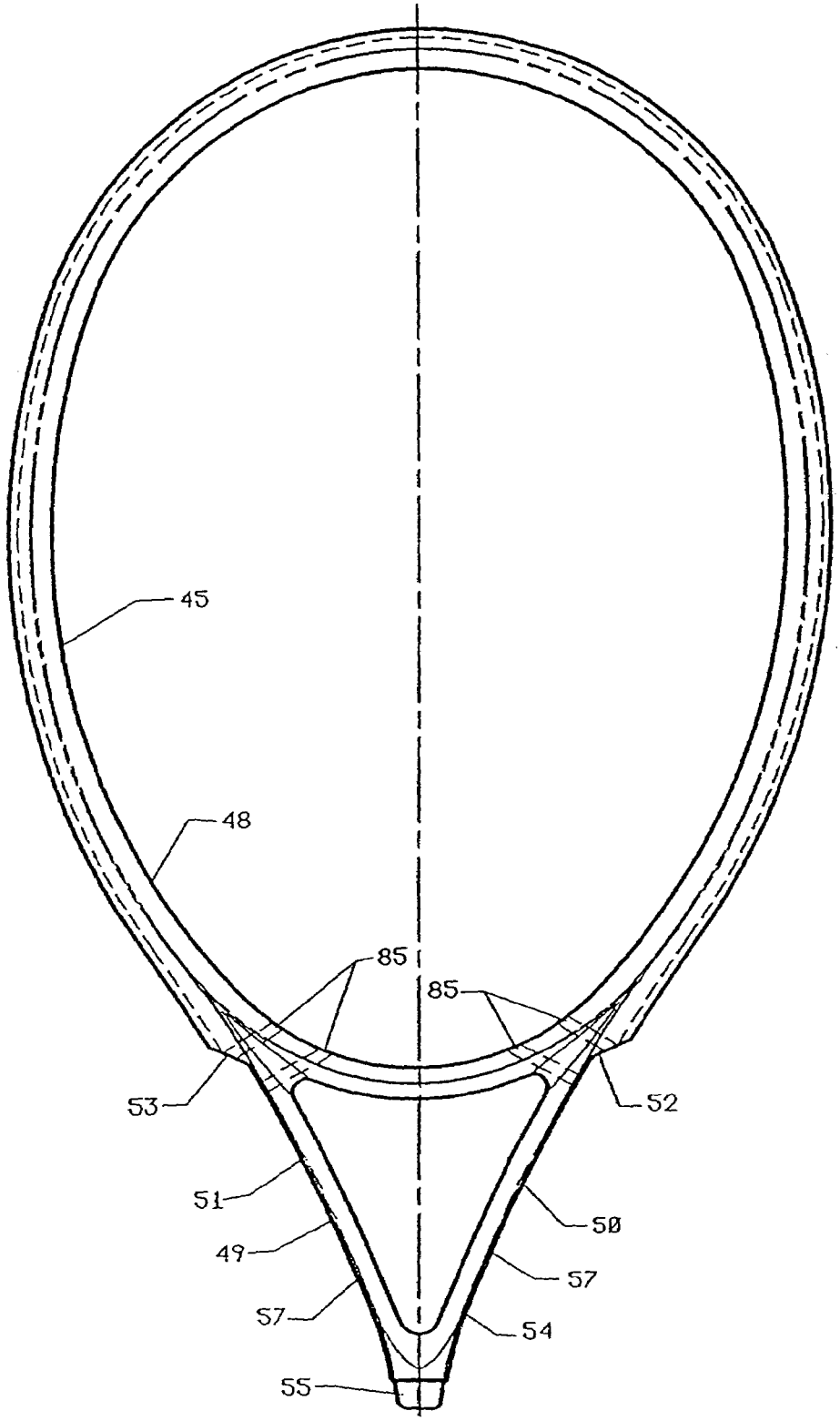
FIG. 5 is a front view of the head portion of the racquet of FIG. 3.
Figure 6:
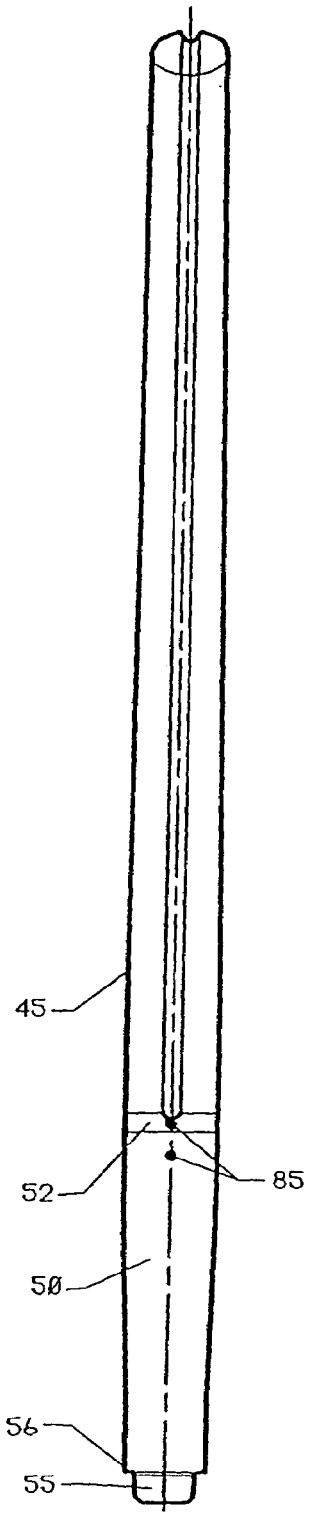
FIG. 6 is a side view of the head portion of FIG. 5.

Referring to FIGS. 5 and 6, the head portion includes a hoop 48 and a V-shaped throat portion 49. The throat portion includes a pair of arms 50 and 51, which extend downwardly from shoulders or undercuts 52 and 53 in the hoop 48 toward the longitudinal centerline CL. The lower ends of the arms are joined by a connecting portion 54, and a tapered projection 55 extends downwardly from the connector 54. Shoulders 56 extend laterally between the projecting 55 and the front and rear faces of the head portion.

Figure 8:
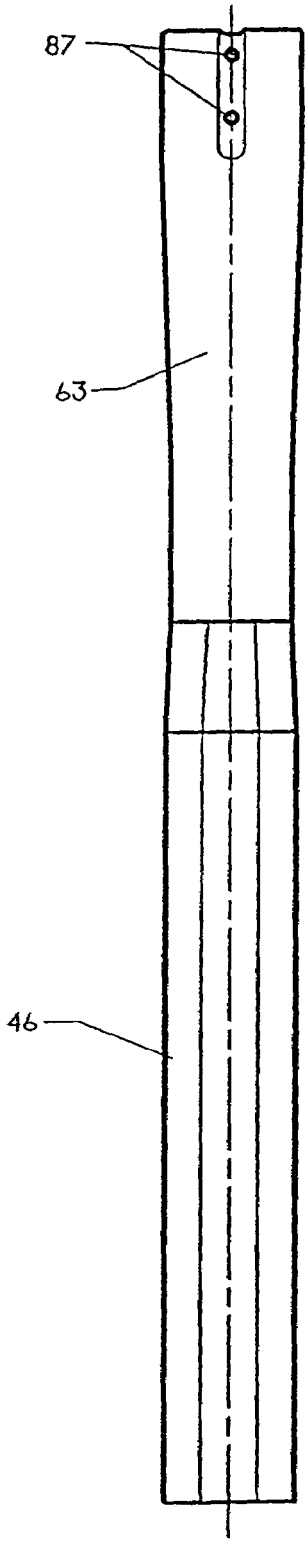
FIG. 8 is a side view of the handle portion of FIG. 7.
Figure 7:
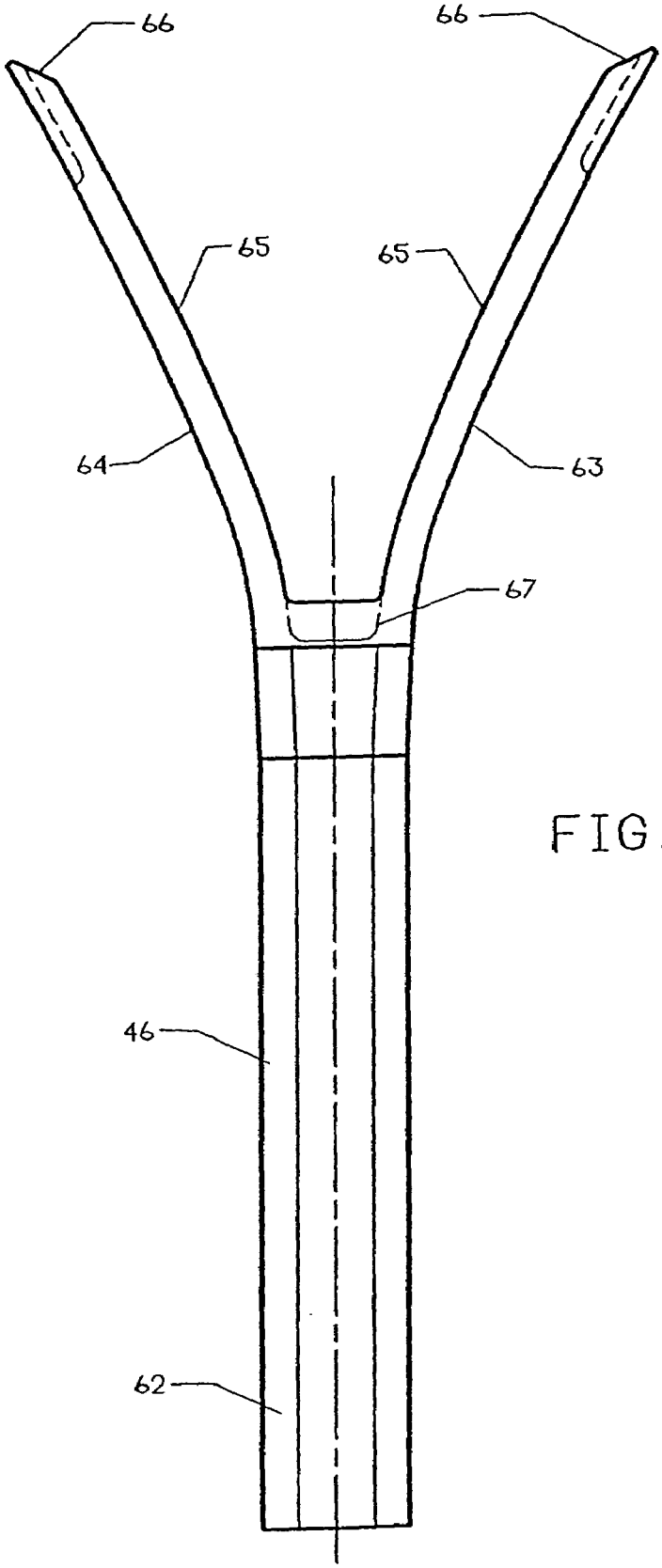
FIG. 7 is a front view of the handle portion of the racquet of FIG. 3.

Referring to FIGS. 7 and 8, the handle portion 46 includes a grip portion 62 and a throat portion, which is formed from a pair of diverging arms 63 and 64. Each arm includes an inside surface 65 and an angled upper end 66 which mates with one of the shoulders 52 or 53. A socket 67 extends into the top of the grip portion between the arms 63 and 64.

Figure 10:
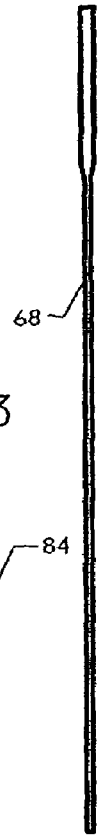
FIG. 10 is a side view of the strip of FIG. 9.
Figure 9:
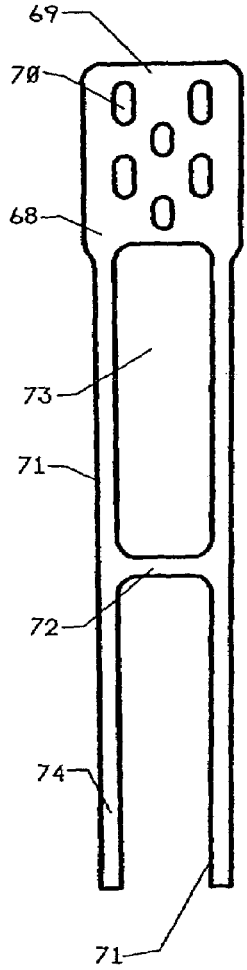
FIG. 9 is a plan view of the strip of shock and/or vibration absorbing material which separates the head and handle portions of FIGS. 5 and 7.

FIGS. 9 and 10 illustrate a panel or sheet 68 of material for absorbing shock and/or vibration which is positioned between the outer surfaces 57 of the throat portion and the inside surfaces 65 of the handle portion. The particular panel illustrated includes a flat end portion 69, which is provided with cutouts or recesses 70 and a pair of elongated parallel strips 71, which are joined by a crosspiece 72. The strips are separated by recesses 73 and 74. The recesses 70, 73, and 74 are intended primarily to reduce the weight of the panel 68. However, the panel could be any shape and could be solid, i.e., without any openings or recesses. Alternatively, the shock and/or vibration absorbing material could be formed from a plurality of separate pieces.

The panel 68 can be formed from any material, which provides shock absorbing and/or vibration dampening properties. Such materials include rubber, synthetic or butyl rubber, Kraton rubber, and urethane. One specific embodiment was made from soft chlorobutyl rubber, which included filler and oils sufficient to provide a Shore A hardness of 33.

The panel 68 preferably has a Shore A hardness within the range of 0 to 90, more preferably within the range of 20 to 70, and most preferably within the range of 30 to 60. Shore A hardness is measured in accordance with ASTM D-2240-00.

Figure 11:
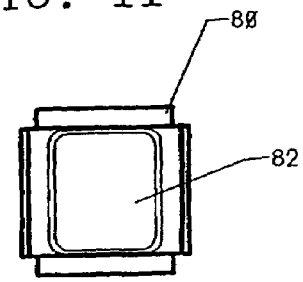
FIG. 11 is a top view of a cap of shock and/or vibration absorbing material which separates the head and handle portions of FIGS. 5 and 7.
Figure 12:
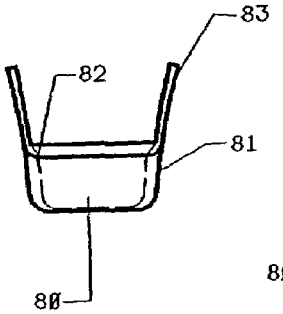
FIG. 12 is a side view of the cap of FIG. 11.
Figure 13:
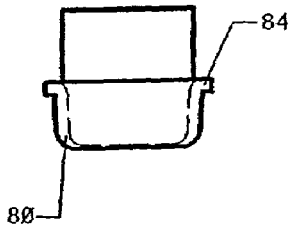
FIG. 13 is a side view of the cap of FIG. 12.
Figure 15:
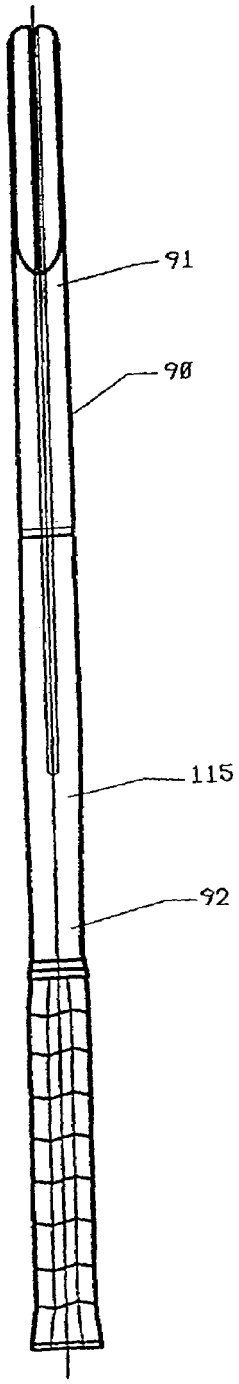
FIG. 15 is a side view of the racquet of FIG. 14.
Figure 14:
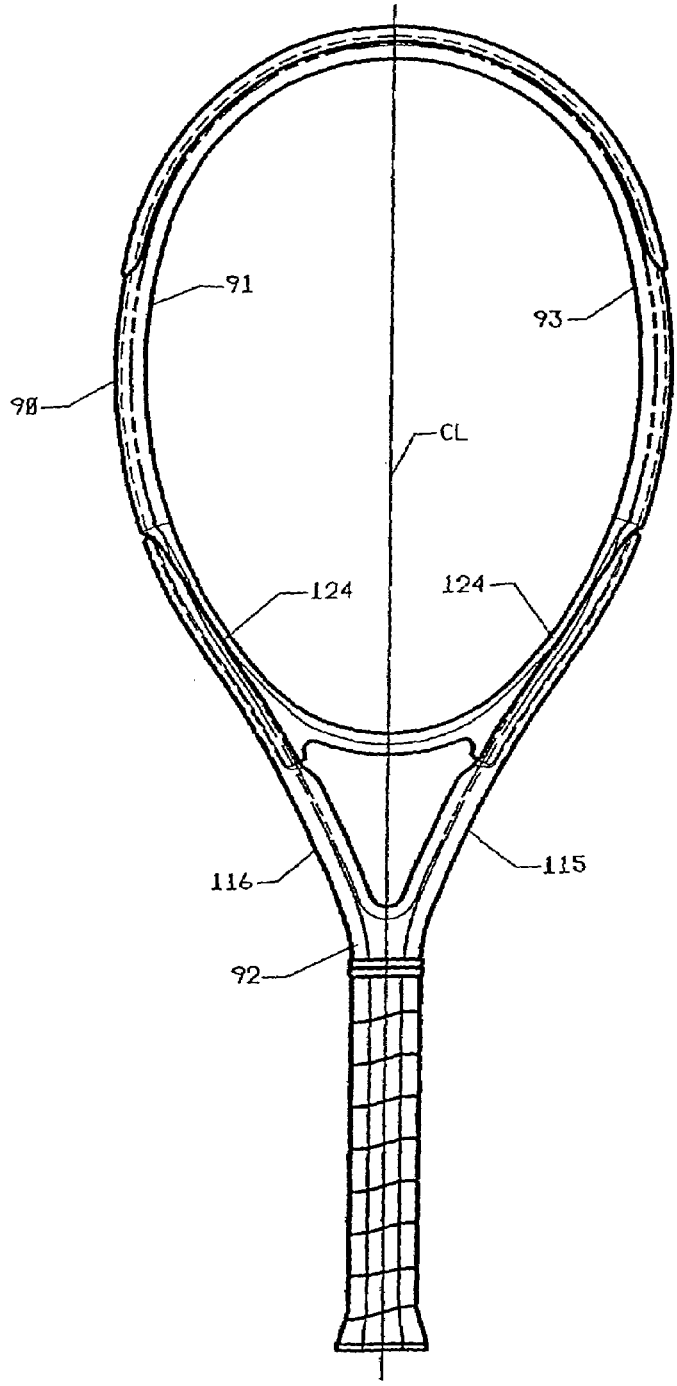
FIG. 14 is a front view of another embodiment of a game racquet which is formed in accordance with the invention.
Figure 16:
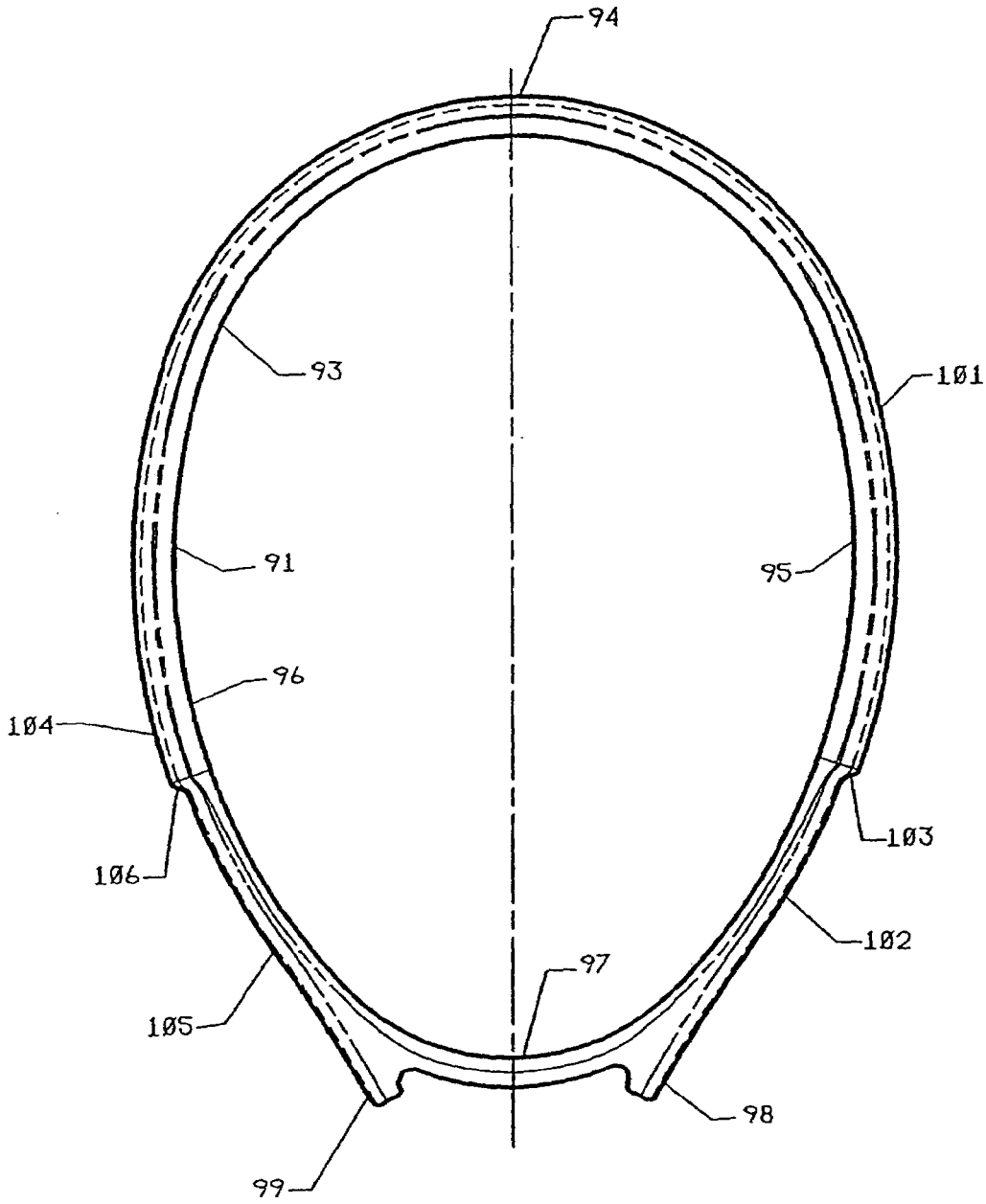
FIG. 16 is a front view of the head portion of the racquet of FIG. 14.
Figure 19:
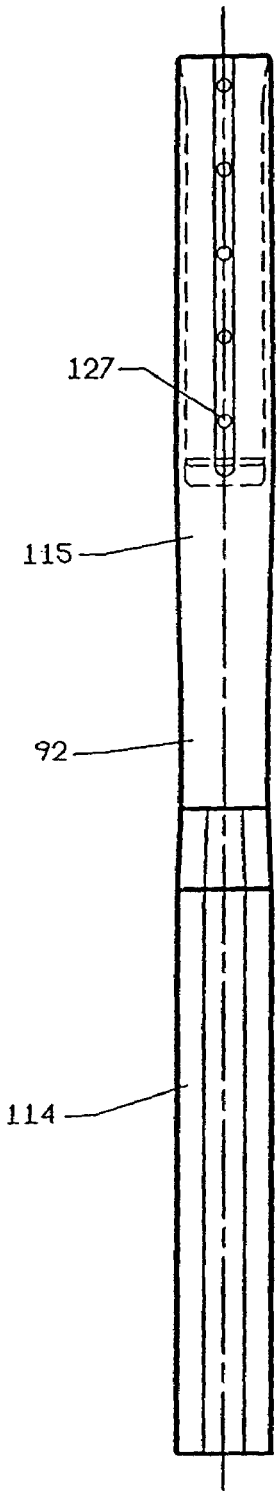
FIG. 19 is a side view of the head portion of FIG. 18.

FIGS. 11-13 illustrate a cup 80 of shock absorbing material, which is positioned between the projection 55 of the head portion and the socket 67 of the handle portion. The cup includes a sidewall 81, which has the same dimensions as the socket 67 and a socket 82, which has the same dimensions as the projection 55. Flanges 83 extend upwardly from two sides of the sidewall 81, and flanges 84 extend laterally from the other sides of the sidewall 81.

The cup 80 is attached to both the projection 55 and the socket 67, preferably by adhesive or an adhesive agent, which will not separate during normal use of the racquet. The preferred adhesive bonding agent is Loctite 496, which is a Cyanoasrylate Ester adhesive. The flanges 83 extend upwardly between the arms 50 and 51 of the head portion and the arms 63 and 64 of the handle portion. The flanges 84 extend between the top of the socket 67 in the handle portion and the shoulders 56 of the head portion. Similarly, a panel 68 is attached to the outer surface 57 of each of the throat arms 50 and 51 and to the inside surface 65 of each of the handle arms 63 and 64. The strips are also preferably bonded by an adhesive, for example, Loctite 496.

The panels 68 and the cup 80 separate or isolate the head portion from the handle portion so that there is no direct contact between those parts. However, since each part is securely bonded to the panels 68 and the cup 80, the parts are connected together by the panels and cup and will not separate during normal use of the racquet. The panels 68 and cup 80 significantly reduce the transmission of shock and vibration from the head portion to the handle portion.

If desired the projection 55 and socket 67 could be omitted. In that event the cap 80 can be replaced by a suitably shaped piece which prevents direct contact between the head and the handle.

A mechanical connection between the head portion and the handle portion can be provided by the racquet strings. Referring to FIG. 5, the head portion is provided with at least one string hole 85 which extends through the undercuts 52 and 53 of the throat arms 50 and 51. A corresponding string hole 87 (FIG. 8) extends through the upper end of each of the handle arms 63 and 64. The holes 85 and 87 are aligned when the head and handle portions are connected by the panels 66 and cup 80. When the racquet is strung, one of the main strings 37 extends through the holes 85 and 89 on each side of the racquet and further secure the head and handle portions together. The strings extend through the middle recesses 70 in the panels 68. Alternatively, the panels 68 could be shaped so that the strings do not pass through the panels.

The mechanical connection, which is provided by the strings, is located near the upper ends of the handle arms 63 and 64. The lower ends of the handle arms are therefore free to move slightly relative to the lower ends of the throat arms 50 and 51 as the panels 68 and cup 80 are compressed by forces which are exerted on the racquet. Such relative movement assists in absorbing shock.

It is not necessary to have the racquet strings extend through the head and the handle. The head and handle could be connected solely by the adhesive bond to the vibration and/or shock absorbing material.

FIGS. 14-19 illustrate another embodiment of a racquet 90 which includes a head portion 91 and a handle portion 92 which extends along the centerline CL. The head portion 91 includes a hoop 93 which has a top portion 94, side portions 95 and 96, and a bottom or yoke portion 97. A pair of short throat portions 98 and 99 extend downwardly from the yoke.

Figure 17:
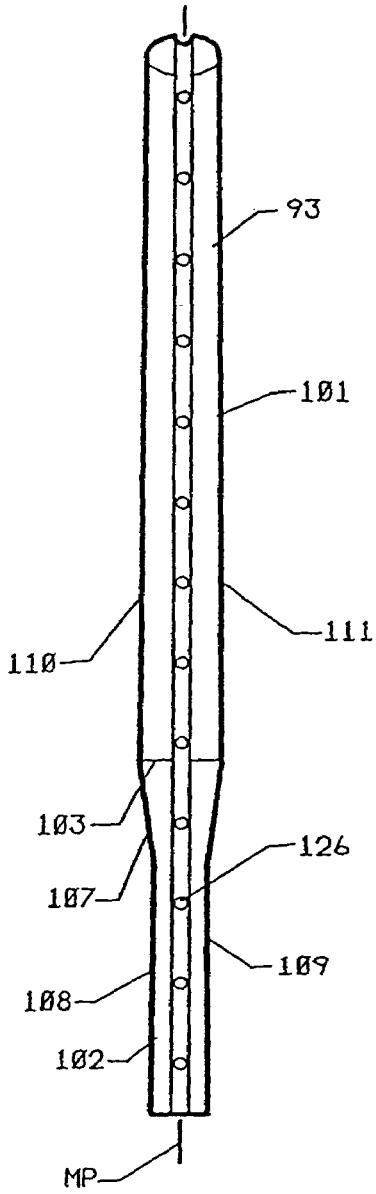
FIG. 17 is a side view of the head portion of FIG. 16.
Figure 18:
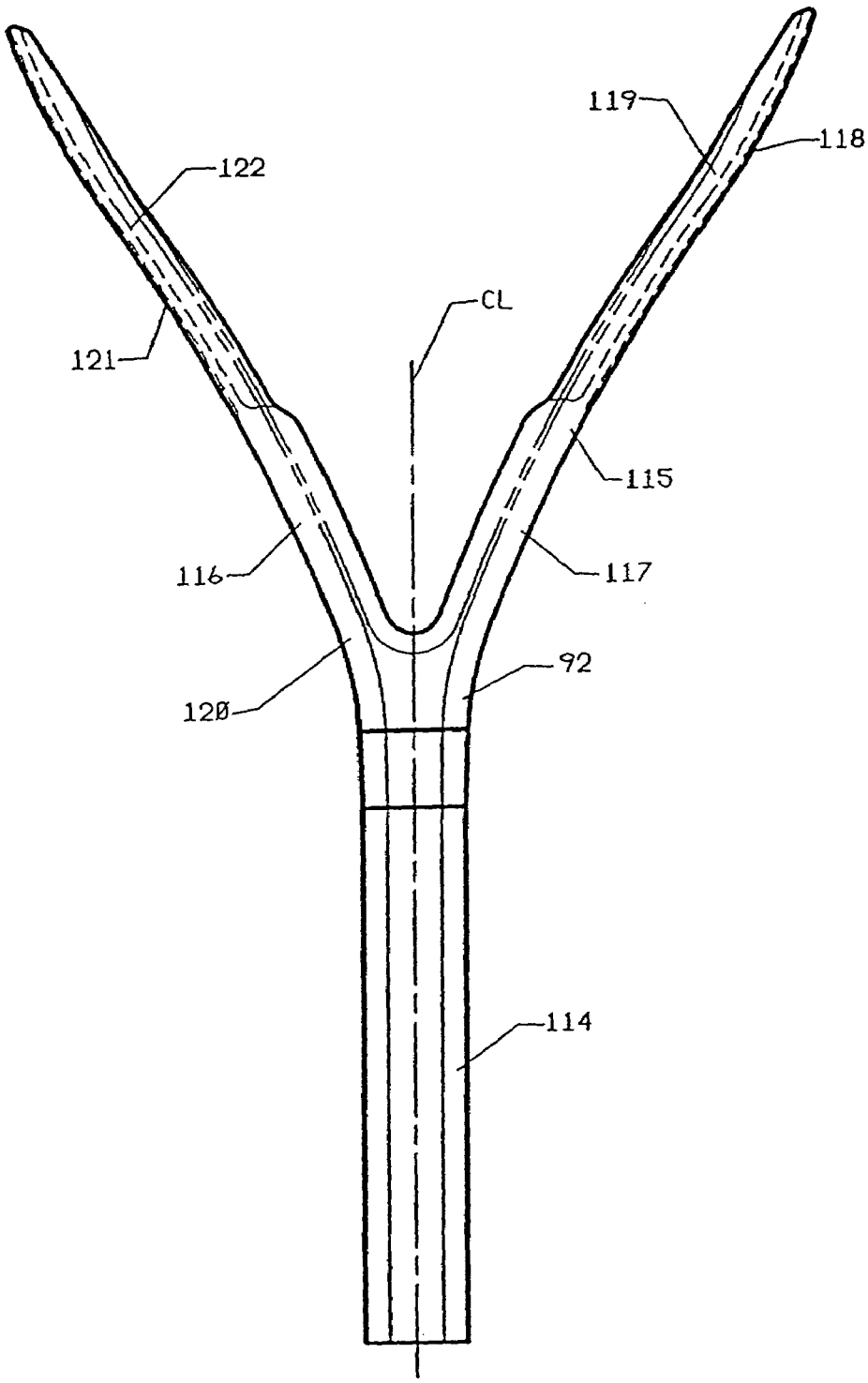
FIG. 18 is a front view of the handle portion of the racquet of FIG. 14.

The side portion 95 includes a first outer edge 101 and a second recessed convex outer surface 102 which extends downwardly from about an undercut 103 at 4:00 o'clock to the end of the throat portion 98. Similarly, the side portion 96 includes a first outer edge 104 and a recessed convex outer surface 105 which extends downwardly from an undercut 106. Referring to FIG. 17, the recessed portions of the sides 95 and 96 taper inwardly at 107 so that the top and bottom edges 108 are offset toward the midplane MP from the top and bottom edges 110 and 111 of the remainder of the head.

The handle portion 92 includes a grip portion 114 and a throat formed by a pair of diverging arms 115 and 116, which extend away from the centerline CL. The arm 115 includes a lower portion 117, which has a concave inside surface 119 which mates with the convex outer surface 102 of the head. The arm 116 similarly includes a lower portion 120 and an upper portion 121, which has a concave inside surface 12 which mates with the convex surface 105 of the head.

A panel 124 of shock and/or vibration absorbing material is inserted between each of the arms 115 and 116 and the head and secured by a chemical or an adhesive bond. Each panel 124 is preferably similar to the panel 68 and is secured by Loctite 496 to both the head and handle portions. The panels isolate the head and handle portions.

A plurality of string holes 126 (FIG. 17) are provided in the recessed side portions 102 and 105, and a plurality of string holes 127 (FIG. 19) are provided in the upper portions 118 and 120 of the arms of the handle portion. Strings, which extend through the string holes 126 and 127, provide an additional mechanical attachment between the head and the handle.

If desired, the arms 115 and 116 of the handle portion can extend upwardly for a greater distance along the sides of the head portion. Also, the short throat portions 98 and 99 of the head can be omitted if desired. The head portion can be entirely hoop-shaped, and the arms of the handle portion can follow the contour of the hoop for any portion of the head which is desired. The handle portion can also extend along the centerline of the racquet up to the head portion so that the racquet does not have an open throat between the head and the handle.

Figure 20:
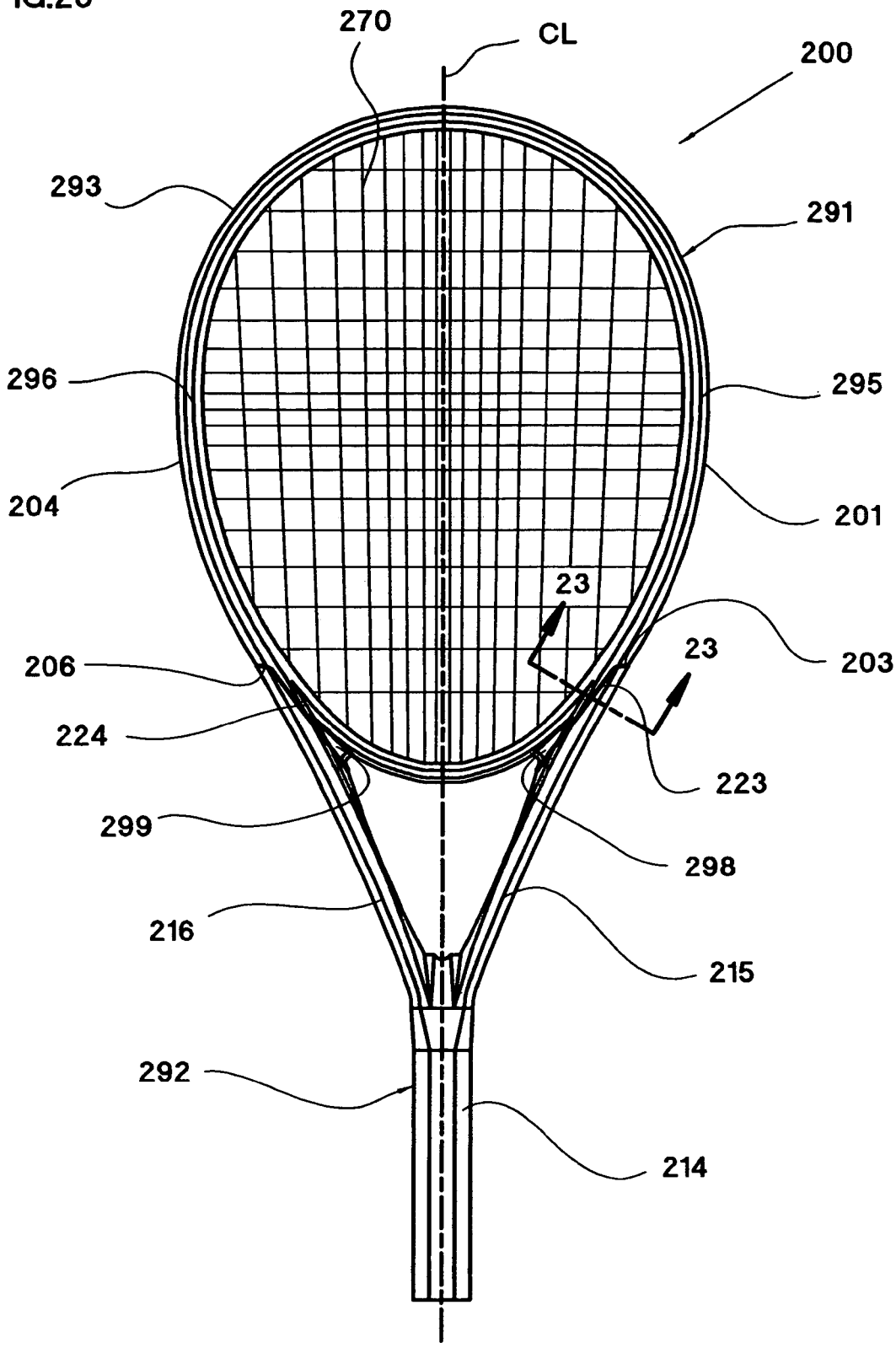
FIG. 20 is a front view of a racquet in accordance with an alternative preferred embodiment of the present invention.
Figure 21:
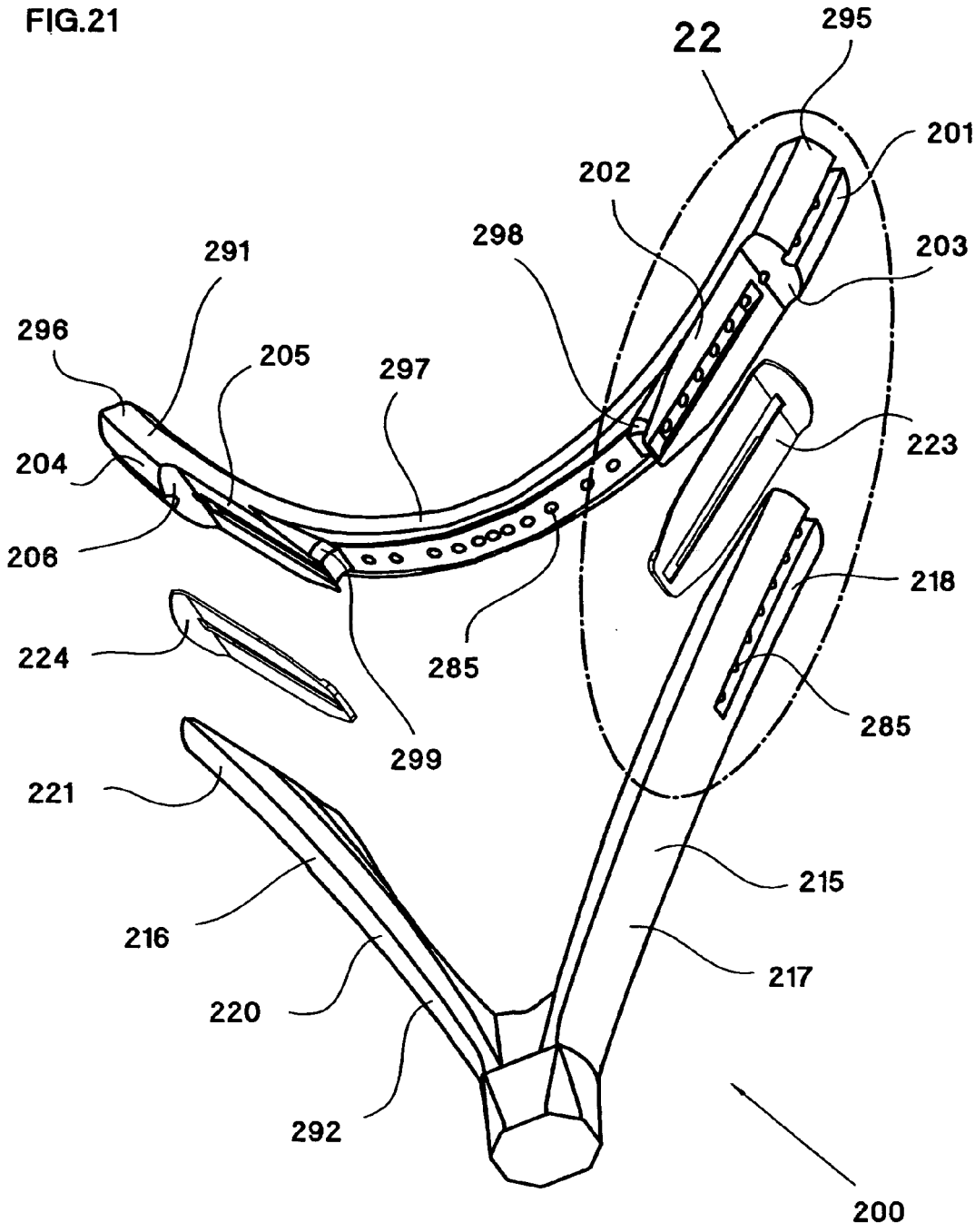
FIG. 21 is an exploded front perspective view of a central portion of the racquet of FIG. 20.

FIGS. 20-24 illustrate an alternative preferred embodiment of a game racquet 200 extending along a longitudinal centerline CL. Referring to FIGS. 20 and 21, the racquet 200 includes head and handle portions 291 and 292 separated by first and second panels 223 and 224. The head and handle portions 291 and 292 are generally similar to the head and handle portions 91 and 92 (see FIG. 14). The head portion 291 includes a hoop 293 having a top portion 294, first and second side portions 295 and 296, and a bottom or yoke portion 297. The hoop 293 supports a string bed 270 formed by a plurality of interwoven main and cross string segments. The string bed 270 generally defines a plane. The first and second side portions 295 and 296 include first and second outer edges 201 and 204, which transition through first and second undercuts 203 and 206 to define first and second recessed outer surfaces 202 and 205, respectively. A plurality of string holes 285 are formed through the hoop 293. Spaced-apart first and second throat projections 298 and 299 downwardly extend from the bottom portion 297.

The handle portion 292 includes a grip portion 214 and a throat formed by first and second diverging arms 215 and 216 upwardly and outwardly extending from the grip portion 214. The first and second arms 215 and 216 having first and second lower portions 217 and 220, and first and second upper portions 218 and 221, respectively. The upper portions 218 and 221 each preferably include a plurality of string holes 285. In alternative preferred embodiments, the lower portions 217 and 220 of the arms 215 and 216 can also include one or more string holes. In other alternative preferred embodiments, the upper and lower portions of each arm can include any number of string holes or be formed without string holes.

The first and second panels 223 and 224 comprise vibration and/or shock absorbing material, such as the material of panel 68. Each of the panels 223 and 224 are configured to conform to the coupled surfaces of the head and handle portions 291 and 292, and to separate the head portion 291 from the handle portion 292.

Figure 22:
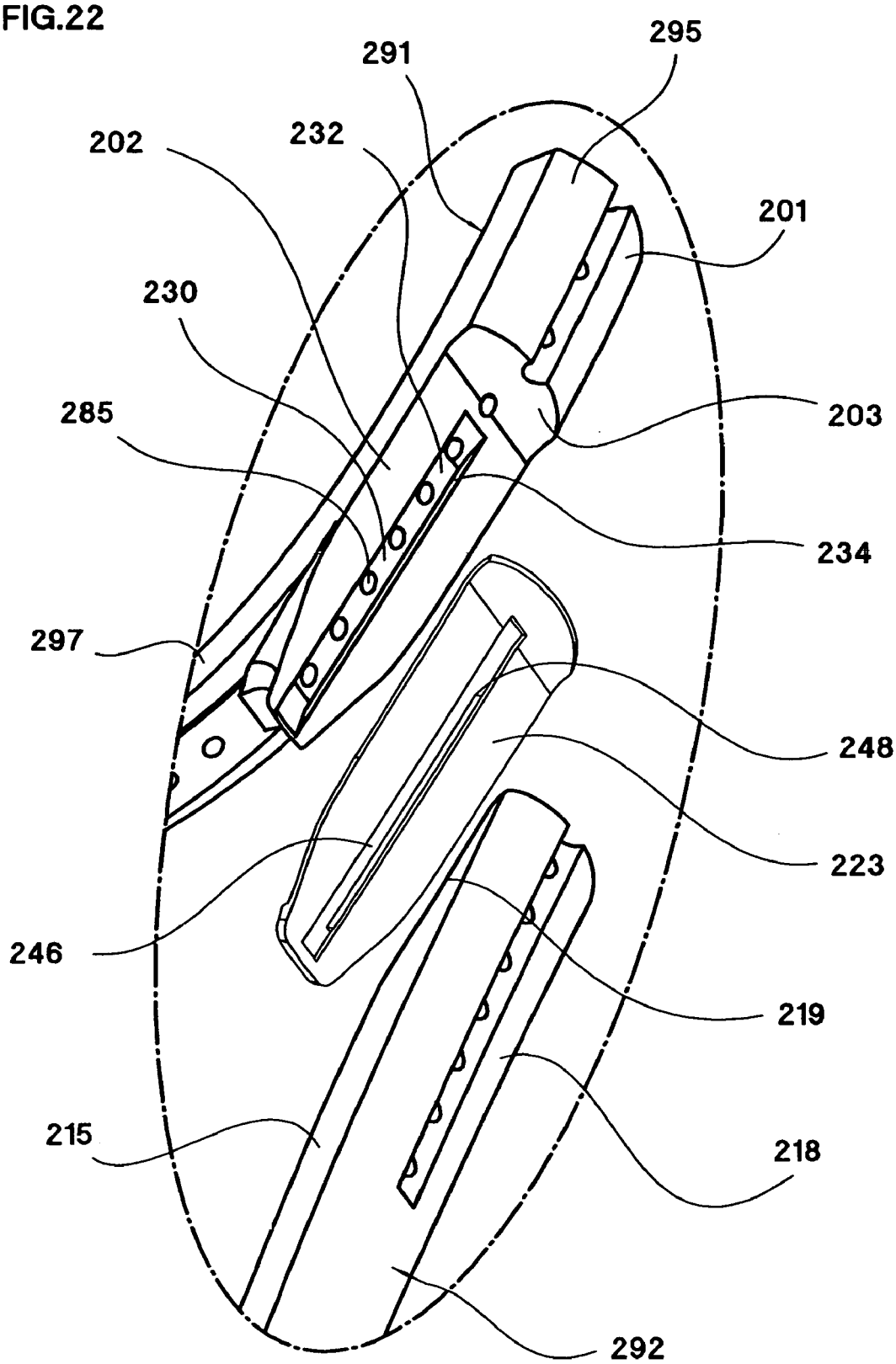
FIG. 22 is an exploded view of the portion of the racquet within the oval marked 22 of FIG. 21.
Figure 23:
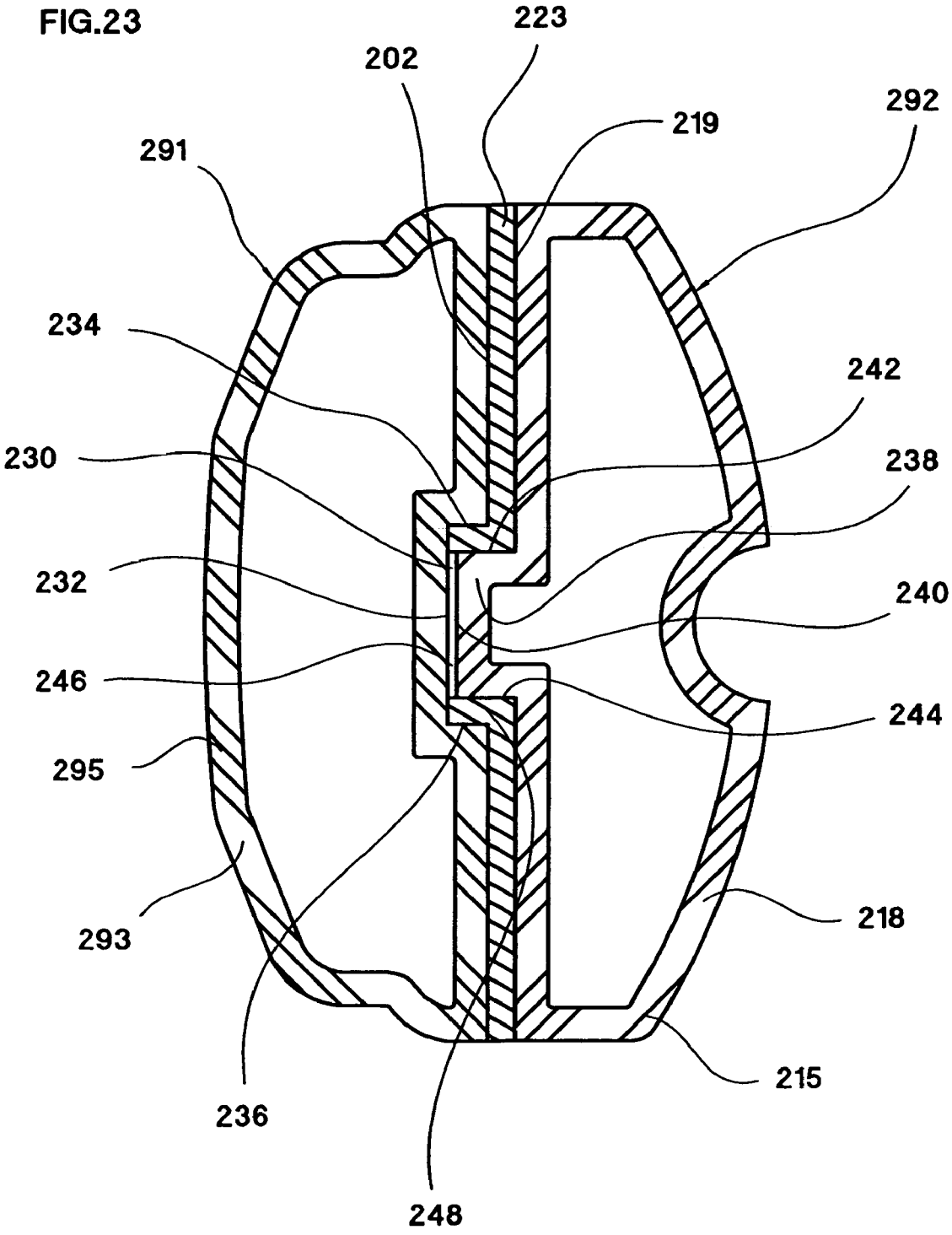
FIG. 23 is a transverse cross-sectional view of the racquet taken along line 23-23 of FIG. 20.
Figure 24:
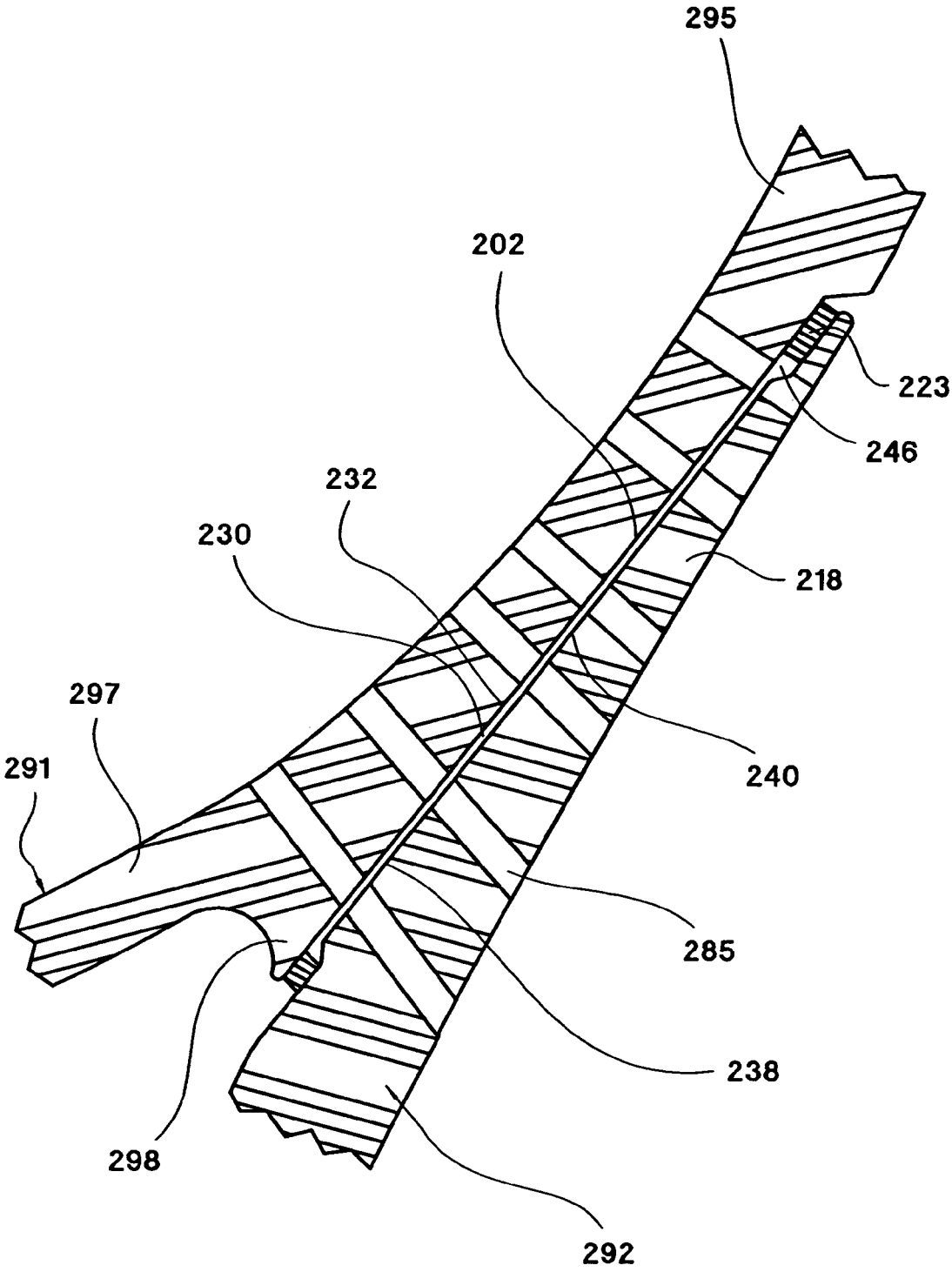
FIG. 24 is a longitudinal sectional view of the central portion of the racquet of claim 20.

Referring to FIGS. 22-24, the coupling of the head and handle portions 291 and 292 with the first panel 223 is shown in greater detail. While FIGS. 22-24 focus on the engagement of the first panel 223 with the head and handle portions 291 and 292 of the racquet 200, the description of this engagement is also directly applicable to the second panel 224.

The first recessed outer surface 202 of the first side portion 295 of the head portion 291 is generally planar and includes a centrally positioned, and longitudinally and inwardly extending channel 230. In alternative preferred embodiments, the first and second recessed outer surfaces 202 and 205 can be concave, convex, or otherwise curved, or irregularly shaped. The channel 230 preferably extends almost the entire length of the recessed outer surface 202. The channel 230 is formed into the first recessed outer surface 202 of the first side portion 295 and is defined by a bottom wall 232 and first and second side walls 234 and 236 outwardly extending from the bottom wall 232. The channel 230 is configured to correspond with and engage the first panel 223 and the first arm 215 of the handle portion 292. In alternative preferred embodiments, the channel can extend over only a portion of the recessed outer surface, can include two or more channels, or can include other shapes when viewed along a transverse plane, such as, for example, U-shape, V-shaped, and other curved or angled shapes.

The upper portion 218 of the first arm 215 includes a generally planar first inside surface 219. Alternatively, the first inside surface 219 can be formed in other shapes that generally conform to the configuration of the first recessed outer surface 202 of the head portion 292, such as, for example, concave, convex, or otherwise curved, or irregularly shaped. The upper portion 218 of the first arm 215 further includes a centrally positioned, and longitudinally and outwardly extending rib 238. The rib 238 is shaped to generally correspond to the shape of the channel 230 and includes a top surface 240 and opposing first and second side surfaces 242 and 244. In alternative preferred embodiments, the rib 238 can be formed in a different shape, such as, for example, semi-cylindrical, polyhedral, and arcuate. The rib can also be formed as two or more outwardly extending projections.

The first panel 223 is an elongate, lightweight, resilient layer of shock and/or vibration absorbing material having a centrally positioned, longitudinally extending slot 246, and including a pair of inwardly projecting, longitudinally ridges 248 positioned on opposite sides of the slot 246. The slot 246 is sized to receive the rib 238. The slot 246 enables racquet string (not shown) to extend through the first panel 223 as it extends through the racquet string holes 285. The first panel 223 is shaped to extend over and space apart first recessed outer surface 202 of the head portion 291 and the first inside surface 219 of the upper portion 218 of the first arm 215. The first panel 223 enables these corresponding surfaces 202 and 219 of the head and handle portions 291 and 292 to be positioned in close proximity to each other while preventing direct contact between the surfaces 202 and 219. The depth of the channel 230 and the placement of the first panel 223 also space apart the top surface 240 of the rib 238 from the bottom wall 232 defining the channel 230, thereby preventing direct contact between the two surfaces. The ridges 248 extend between, and space apart, the first and second side walls 234 and 236 defining the channel 230 of the head portion 291 and the first and second side surfaces 242 and 244 of the rib 238 of the arm 215.

By providing a layer of shock and/or vibration absorbing material between the corresponding surfaces of the head and handle portions 291 and 292, the first panel 223 reduces the amount and severity of the shock and/or vibration generated at the head portion during play, which extends from the head portion 291 to the handle portion 292. Further, the alignment of the first and second side surfaces 242 and 244 of the rib 238 with the first and second side walls 234 and 236 of the channel 230 improves the racquet's 200 capacity to withstand the direct, shear and torsional stresses exerted on to the racquet 200 during play. The alignment and spaced-apart engagement of the rib 238 with the channel 240 further secure the proper alignment of the head and handle portions 291 and 291, strengthen the coupling of the head and handle portions 291 and 292, and provide additional surface area for bearing and absorbing the stresses and impact loads resulting from a ball contacting the racquet during play.

In an alternative preferred embodiment, the channel(s) can be formed into one or more of the first and second arms, and the rib(s) can be formed on head portion of the racquet. In another alternative preferred embodiment, one arm of the handle portion can include a channel and the other arm a rib, and one side of the head portion can include a channel and the other side a rib.

Figure 25:
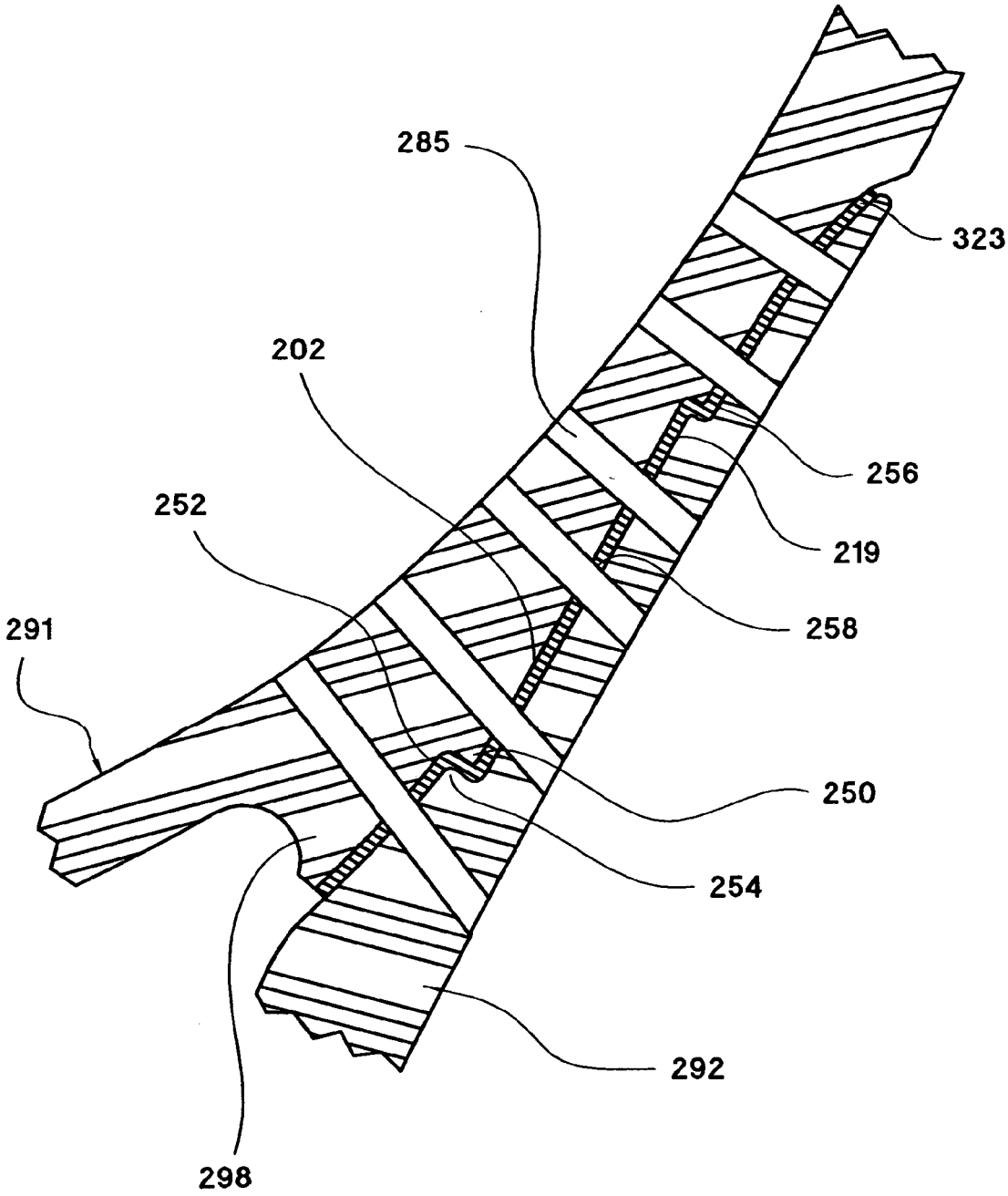
FIG. 25 is a longitudinal sectional view of a central portion of a racquet in accordance with an another alternative preferred embodiment of the present invention.

Referring to FIG. 25, in an alternative preferred embodiment, the corresponding first and second outer recessed surfaces 202 and 205 of the head portion 291, and the first inside surface 219 of the first arm and the second inside surface of the second arm 216, respectively, include at least one set of corresponding projections and recesses. FIG. 25 illustrates the coupling of the first outer recessed surface 202 with the first inside surface 219, which is substantially similar, and a mirror image of, the opposite side of the racquet 200. In a particularly preferred embodiment, the first outer recessed surface 202 includes a generally jagged or serrated surface, preferably having at least two head projections 250 and at least two head recesses 252. Similarly, the first inside surface 219 of the first arm 215 includes at least two handle projections 254 and at least two handle recesses 256 configured to correspond with the head projections and recesses 250 and 252 of the head portion 291 of the racquet 200. Alternatively, other numbers of corresponding projections and recesses can be used. A first panel 323 is configured to conform to, and space apart, the first outer recessed surface 202 of the head portion 291, and the first inside surfaces 219 of the handle portion 292. The first panel 323 is generally similar to the first panel 223. The first panel 323 includes a plurality of apertures 258 for receiving the racquet string extending through the string holes 285 of the head and handle portions 291 and 292. Alternatively, the first panel 323 can be configured with one or more slots or openings for receiving the racquet string.

The engagement of the corresponding at least one projection and at least one recess of first outer recessed surface 202 and the first inside surface 219 inhibits the movement or displacement of the head portion 291 in a direction toward the handle portion 292, which can occur in some racquets. For example, if a racquet includes elongated main string segments extending through the bottom portion, or yoke, of the head portion to engage the handle portion, the string tension applied to the main string segments can act to draw the head portion further into the handle portion between the first and second arms. The projections and recesses, or generally jagged or serrated corresponding surfaces, of the head and handle portion form one or more stops which inhibit and resist the forces causing such movement of the head portion closer to the handle portion. The projections and recesses further secure the coupling of the head and handle portions 291 and 292 of the racquet.

Figure 26:
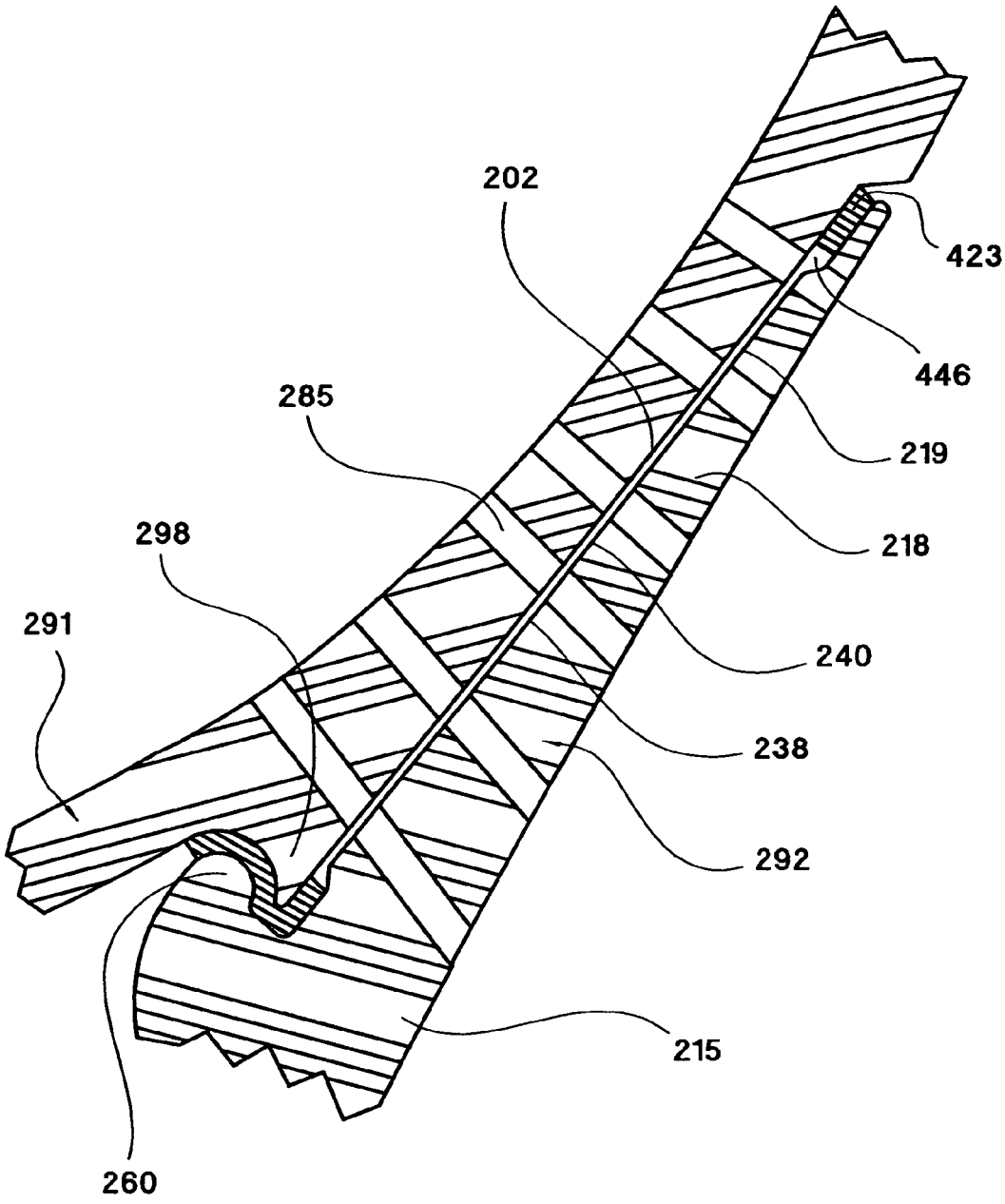
FIG. 26 is a longitudinal sectional view of a central portion of a racquet in accordance with an another alternative preferred embodiment of the present invention.

Referring to FIG. 26, another alternative preferred embodiment of the coupling of the head and handle portions 291 and 292 of the racquet 200 is illustrated. FIG. 26 includes only the first side of the racquet 200, however, the second side of the racquet is substantially a mirror image of the first side of the racquet. The upper portion 218 of the first arm 215 of the handle portion 291 further includes a catch 260 configured to generally correspond to the first throat projection 298 of the head portion 291. The catch 260 is a rounded upwardly and inwardly extending projection configured to generally conform to the outer surface of the head portion 291 at the first throat projection 298. Alternatively, the catch 260 can be formed in other shapes generally corresponding to the first throat projection.

A first panel 423, substantially similar to the first panel 223, extends over and between the corresponding portions of the catch 260 and the first throat projection 298 to engage, and space apart, the catch 260 and the first throat projection 298. The first panel 423 includes a slot 446 for receiving the racquet string extending through the string holes 285 of the head and handle portions 291 and 292. The first panel 423, like the first panel 223, spaces apart, and prevents direct contact between, the head and handle portions 291 and 292. Similar to the jagged or serrated surfaces of FIG. 26, the catch 260 is configured to engage the first throat projection 298 and inhibit and resist the movement or displacement of the head portion 291 of the racquet 200 in the direction of the handle portion 292. The catch 260 further strengthens and secures the coupling of the head and handle portions 291 and 292.

While in the foregoing specification a detailed description of specific embodiments of the invention has been set forth for the purpose of illustration, it will be understood that many of the details hereingiven can be varied considerably by those skilled in the art without departing from the spirit and scope of the invention. For example, where the head and/or hoop portions are formed of a thermoplastic resin material, the shock and/or vibration absorbing material coupling the head and handle portions can be reduced in size or eliminated.

What is claimed is:

1. A game racquet comprising:

a head portion including a fiber-reinforced thermoset material; and a handle portion coupled to the head portion, the handle portion including a fiber-reinforced thermoplastic material.

2. The racquet of claim 1, wherein the head portion is formed separately from the handle portion.

3. The racquet of claim 2, further comprising:

shock and/or vibration absorbing material positioned between the head portion and the handle portion, wherein the head and handle portions are secured to the absorbing material.

4. The racquet of claim 3, wherein the absorbing material is formed of a material selected from the group consisting of natural rubber, synthetic rubber, butyl rubber, urethane, and combinations thereof.

5. The racquet of claim 3, wherein the hoop and the handle portion are secured to the absorbing material by adhesive.

6. The racquet of claim 1, wherein the fibers used in the fiber reinforced thermoset and thermoplastic materials are selected from the group consisting of fiberglass, carbon, ceramic, aramid, high molecular weight polyethylene in strand form, and combinations thereof.

7. The racquet of claim 1, wherein the fiber reinforced thermoplastic material includes nylon.

8. The racquet of claim 1, wherein the fiber reinforced thermoplastic material includes urethane.

9. A game racquet comprising:

a head portion formed of a fiber-reinforced thermoplastic material; and a handle portion coupled to the head portion, the handle portion formed of a fiber-reinforced thermoset material.

10. The racquet of claim 9, wherein the head portion is formed separately from the handle portion.

11. The racquet of claim 10, further comprising:

shock and/or vibration absorbing material positioned between the head portion and the handle portion, wherein the head and handle portions are secured to the absorbing material.

12. The racquet of claim 11, wherein the absorbing material is formed of a material selected from the group consisting of natural rubber, synthetic rubber, butyl rubber, urethane, and combinations thereof.

13. The racquet of claim 11, wherein the hoop and the handle portion are secured to the absorbing material by adhesive.

14. The racquet of claim 9, wherein the fibers used in the fiber reinforced thermoset and thermoplastic materials are selected from the group consisting of fiberglass, carbon, ceramic, aramid, high molecular weight polyethylene in strand form, and combinations thereof.

15. The racquet of claim 9, wherein the fiber reinforced thermoplastic material includes nylon.

16. The racquet of claim 9, wherein the fiber reinforced thermoplastic material includes urethane.

17. A game racquet having a string bed including main and cross strings, the racquet comprising:

a head portion including a hoop having an outer periphery, the hoop formed of a fiber-reinforced thermoset material;

a handle portion formed separately from the head portion, the handle portion formed of a fiber-reinforced thermoplastic material; and shock and/or vibration absorbing material disposed between and directly connecting the head portion and the handle portion at at least one location about the outer periphery of the hoop.

18. The racquet of claim 17, wherein the at least one location generally extending at a position toward the handle portion and beneath the lowest cross string when viewed with the racquet positioned vertically and the head portion generally positioned above the handle portion.

19. The racquet of claim 17, wherein the head portion includes a throat portion outwardly extending from the outer periphery of the hoop.

20. The racquet of claim 17, wherein the at least one location includes two or more spaced apart locations about the outer periphery of the hoop.

21. The racquet of claim 19, wherein the absorbing material is also disposed between the throat portion and the handle portion.

22. The racquet of claim 17, wherein the hoop and the handle portion are secured to the absorbing material by adhesive.

23. The racquet of claim 17, wherein the absorbing material is formed of a material selected from the group consisting of natural rubber, synthetic rubber, butyl rubber, urethane, and combinations thereof.

24. A game racquet having a string bed including main and cross strings, the racquet comprising:

a head portion including a hoop having an outer periphery, the hoop formed of a fiber-reinforced thermoplastic material;

a handle portion formed separately from the head portion, the handle portion formed of a fiber-reinforced thermoset material; and shock and/or vibration absorbing material disposed between and directly connecting the head portion and the handle portion at at least one location about the outer periphery of the hoop.

25. The racquet of claim 24, wherein the at least one location generally extending at a position toward the handle portion and beneath the lowest cross string when viewed with the racquet positioned vertically and the head portion generally positioned above the handle portion.

26. The racquet of claim 24, wherein the head portion includes a throat portion outwardly extending from the outer periphery of the hoop.

27. The racquet of claim 26, wherein the absorbing material is also disposed between the throat portion and the handle portion.

28. The racquet of claim 24, wherein the at least one location includes two or more spaced apart locations about the outer periphery of the hoop.

29. The racquet of claim 24, wherein the hoop and the handle portion are secured to the absorbing material by adhesive.

30. The racquet of claim 24, wherein the absorbing material is formed of a material selected from the group consisting of natural rubber, synthetic rubber, butyl rubber, urethane, and combinations thereof.

* * * * *